United States Patent [19]

Giorgini et al.

[11] 4,255,650

[45] Mar. 10, 1981

[54] MECHANICAL COUNTER

[75] Inventors: Norman L. Giorgini, West St. Paul; John W. Ulseth, Roseville, both of Minn.

[73] Assignee: Minnesota Mining and Manufacturing Company, St. Paul, Minn.

[21] Appl. No.: 71,119

[22] Filed: Aug. 30, 1979

[51] Int. Cl.[3] ..... G06M 1/00

[52] U.S. Cl. ..... 235/91 R; 235/132 R

[58] Field of Search ..... 235/91 R, 132 R, 117 A, 235/132 A, 132 E

[56] References Cited

U.S. PATENT DOCUMENTS

| | | | |
|---|---|---|---|
| 2,266,862 | 12/1941 | Hardey | 235/132 R |
| 3,378,196 | 4/1968 | Gudmestad | 235/132 R |
| 3,550,458 | 6/1969 | Dunlop et al. . | |
| 3,564,593 | 10/1969 | Bielik | 235/91 R |
| 3,641,322 | 2/1972 | Limberger . | |
| 3,863,052 | 1/1975 | Collette . | |

*Primary Examiner*—L. T. Hix
*Assistant Examiner*—Benjamin R. Fuller
*Attorney, Agent, or Firm*—Cruzan Alexander; Donald M. Sell; William L. Huebsch

[57] ABSTRACT

A mechanical counting device for use in office machines such as copying machines in which almost all of the operative structure has been integrated into a single component. The surface works in conjunction with a ratchet pawl to count down from a preselected number, the number of completed cycles performed by the office machine. The counter energizes and de-energizes the office machine's operation at the start and finish respectively of this preselected number of cycles. In addition the counter includes a position for the continuous operation of the office machine without counting, and the capability to stop the operation of the office machine without disrupting the counting sequence.

10 Claims, 4 Drawing Figures

MECHANICAL COUNTER

BACKGROUND OF THE INVENTION

This invention relates to an inexpensive counting device which can be set to a predetermined number of counting cycles and used to actuate an apparatus such as a copy machine.

There are many variations of mechanical counting devices presently available. A typical example is described by U.S. Pat. No. 3,863,052 issued Jan. 28, 1975 to Richard R. Collette et al. It is characteristic of this as well as the other counting devices to employ a series of separate register members or indexing members to facilitate the counting operation. These complex multiple and separate members inherently entail increased costs and subject the device to a greater probability of failure.

SUMMARY OF THE INVENTION

The counter of the present invention is a simplified device wherein almost all of the operative structure has been integrated into one inexpensive and durable component.

The counter comprises an indicator knob rotatably and slidably mounted on a spindle within the framework of some apparatus. This knob is capable of being rotated to a predetermined number of counting cycles and then pressed to energize a circuit of this apparatus, for example, a drive or copying circuit of a copy machine. The knob includes releasable latch means to maintain this circuit energized until the chosen number of cycles has been completed, at which time it will automatically release the knob and de-energize the circuit. The knob also includes a ratchet surface formed substantially around its periphery. This ratchet surface works in cooperation with a ratchet pawl rotatably and slidably mounted on the spindle and activated by the operation of the apparatus to rotate the knob during each counting cycle, thus performing the counting function.

This device further comprises means for automatically interrupting the counting cycle as well as means for overriding the counter in order to operate the assembly continuously.

DESCRIPTION OF THE ACCOMPANYING DRAWINGS

The above invention will be further understood after reading the following description which refers to the accompanying drawings wherein.

DETAILED DESCRIPTION OF THE PREFERRED EMBODIMENT

Figure 1:
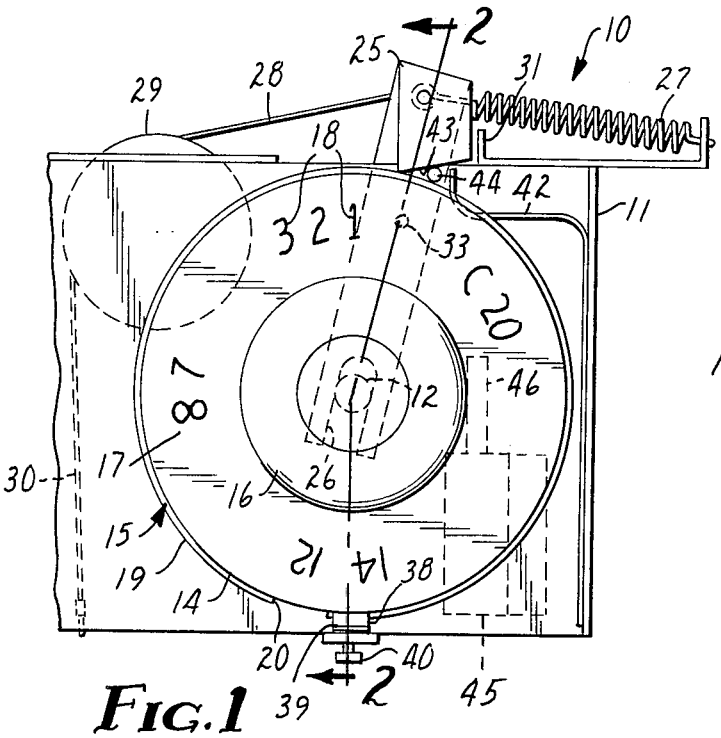
FIG. 1 is a frontal plan view of the counter.
Figure 2:
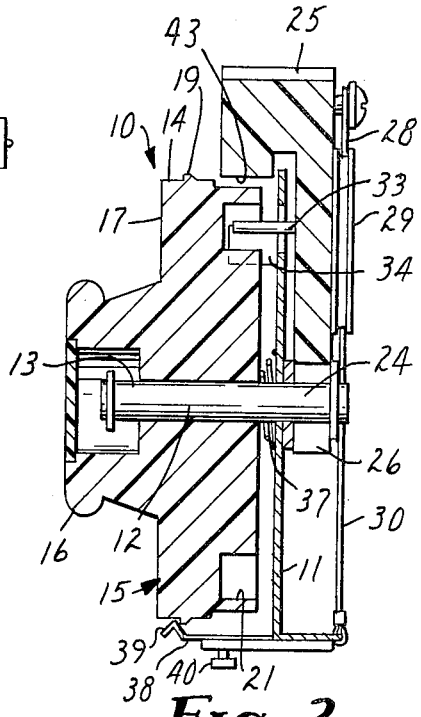
FIG. 2 is a horizontal sectional view of the counter along line 2—2' of FIG. 1.
Figure 3:
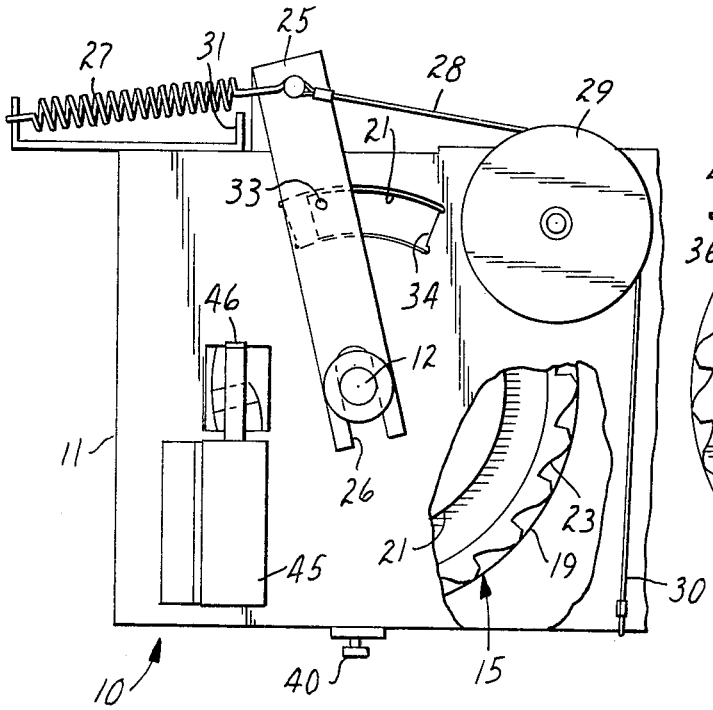
FIG. 3 is a rear plan view and is partly broken away to show interiorly located structure.

Referring now to the drawing, a mechanical counter 10 is disclosed which is adapted to be mounted on most any apparatus and coupled to some mechanism (not shown) within that apparatus for operation of a counting function.

The counter 10 includes a frame 11 to mount the counter 10 onto an apparatus. The frame 11 also serves as a mounting for a central spindle 12 which extends through frame 11 and is rigidly welded to frame 11. A ratchet pawl 25 is rotatably and slidably mounted for radial movement on the inferior portion 24 of spindle 12. In effect, the ratchet pawl 25 has a groove 26 of a slightly larger width than the diameter of the spindle 12 and a length of about 1½ centimeters (0.59 inch), thus allowing the pawl 25 to rotate and radially slide on spindle 12. The pawl 25 is biased toward one side of the frame 11 by pawl spring 27. A trip cable 28 is attached between the ratchet pawl 25 and the frame 11. This trip cable 28 is directed over a pulley 29 mounted in frame 11 to control the direction from which the trip cable 28 will pull the ratchet pawl 25.

The superior portion 13 of spindle 12 serves as a mounting for an indicator knob 15. This knob 15 is preferably molded from Delrin, nylon, or any suitable polymeric material. The knob 15 is disc-shaped and has a graspable protrusion 16 extending from one of its axially facing sides, serving as a handle enabling an operator to manually rotate the knob 15. In the preferred embodiment the graspable protrusion has a circular top portion with a cylindrical connecting portion having a reduced diameter and connecting the top portion to the axially facing side, although any similar configuration allowing the operator to grasp and rotate the knob would be acceptable. On this same side is a flat surface 17 on which are printed indicia 18 indicating the number of cycles to be counted. In the illustrated embodiment, the sequential numbers "1–20" and the letter "C" are printed on this flat surface 17 of the knob 15 to indicate to the operator the number of counting cycles being performed. Extending from the periphery 14 of the knob 15 is a ratchet surface 23 when the counter 10 uses to rotate the knob 15 around the central spindle 12. This surface is rotated by the ratchet pawl 24 previously described.

The knob 15 also provides limiting means interacting with the frame 11 for limiting the rotational movement of the knob 15 about the spindle 12. The limiting means comprises an annular groove 21 on the opposing side of knob 15 as the graspable protrusion 16 previously mentioned. This groove 21 partially encircles the spindle 12, with a raised surface 22 separating the ends of the groove 21. A tab 34 extends from the frame and is disposed to engage groove 21. As knob 15 is rotated, tab 34 eventually contacts raised surface 22 which acts as a stop to limit the rotation of knob 15 about spindle 12.

A knob spring 37 is located on the spindle 12 between the knob 15 and the frame 11. This knob spring 37 urges the knob 15 to its most distal position with respect to the frame 11. Also affixed to frame 11 is a catch spring 38. One end 39 of this catch spring 38 is v-shaped to engage a projecting flange 19 on the peripheral surface 14 of knob 15. In this manner latch means is created for holding knob 15 in a proximate position to frame 11. It should be noted that the catch spring 38 is biased to exert a lateral force on knob 15. This force provides friction on the peripheral surface 14 of knob 15. By adjusting this catch spring 38 with the provided adjustment screw 40, the frictional force and thus the effort required to lift or depress the knob 15 can be controlled.

There is also switch means mounted on frame 11 comprising a switch 45 actuated by switch plunger 46. This plunger is disposed in frame 11 such that it will turn switch 45 on when knob 15 is manually pushed to its most proximate position with respect to frame 11. As previously described, catch spring 38 facilitates the latching of the knob 15 in this proximate position.

Figure 4:
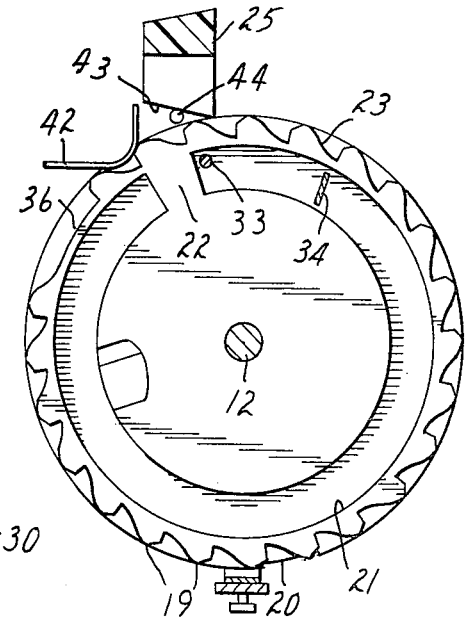
FIG. 4 is an elevational view of the knob according to the present invention showing interiorly located structure.

A detent spring 42 is also affixed to frame 11. This detent spring 42 engages ratchet surface 23 of knob 15 and limits the rotation of knob 15 to discrete intervals as determined by the spacings of the ratchet surface 23. It should be pointed out that the ratchet surface 23 has been modified to allow the effect of the detent spring 42 to be equally present regardless of the rotational direction of the knob 15. This modification as apparent from FIG. 4 is the "v" shaped profile of the ratchet surface 23 rather than the normal saw tooth profile.

A retaining pin 33 is affixed to ratchet pawl 25. This retaining pin 33 is disposed to engage the raised surface 22 of annular groove 21 for the purpose of restoring the knob 15 to its home position after the completion of the counting sequence.

To operate counter 10 the operator selects from the indicia 18 the number of cycles to be counted and manually rotates knob 15 to the indicium reflecting this number. The operator then pushes knob 15 to its proximate position to the frame 11. This action causes plunger 46 to close switch 45 which initiates the activity to be counted with the apparatus. As the apparatus completes a cycle a force is exerted on the lower portion 30 of trip cable 28, as for example, by a cam mechanism (not shown) within the apparatus. The action of the trip cable 28 causes a downward and rotational movement of pawl 25, affording the engagement of ratchet surface 23, thereby rotating knob 15. Knob 15 will rotate one interval as determined by detent spring 42. As the force on trip cable 28 is relaxed, pawl spring 27 restores pawl 25 to its original position. The disengagement of pawl 25 from ratchet surface 23 is ensured by a ramp surface 43 on pawl 25 riding against withdrawal post 44 on frame 11 during this restoration movement due to spring 27. These counting cycles are repeated until catch spring 38 reaches an interruption 20 in the flange 19 on the periphery 14 of knob 15. This interruption 20 affords the disengagement of the catch spring 38 causing the knob 15 to move to its distal position under the influence of the knob spring 37. The movement of the knob 15 to this distal position opens the switch 45 which de-energizes the apparatus and thus the counting operation.

When the knob 15 reaches a position corresponding to the indicium "1", the restorational movement of the pawl 25 causes the retaining pin 33 to engage the raised surface 22 of the groove 21. The biasing force of the spring 27 is adequate to rotate and restore the knob 15 to its original position as well as restoring the pawl 25.

At any time during the counting sequence the operator can interrupt the counting cycle by manually pulling the knob 15 to its distal position thereby opening the switch 45. The leaf spring 38 has sufficient resilience to permit its movement over the flange 19 under the influence of the operator's force. This action stops the counting sequence but maintains the count reached to that time (i.e., the knob 15 retains its rotational position). The operator can resume the counting sequence by re-pressing the knob 15.

If continuous operation of the apparatus is desired, that operator can manually rotate knob 15 to a position corresponding to the indicium "C" and push the knob 15 inwards. Since no teeth are present on the ratchet surface 23 at this position, the action of the ratchet pawl 25 will not rotate the knob 15. Hence no counting operation will be performed and the apparatus will operate until the knob 15 is manually withdrawn from its proximate position.

Having described a preferred embodiment of the present invention it will be understood that changes may be made in size, shape, or configuration of some of the parts without departing from the present invention as described in the appended claims.

What is claimed:

1. A counting device operative to energize a circuit and maintain said circuit energized for a predetermined number of cycles of operation after which said device will automatically open said circuit, said device comprising a frame, a central spindle affixed to said frame, a ratchet pawl rotatably and slidably mounted on said spindle so as to allow rotation about said spindle during each cycle, biasing means connected between said pawl and said frame for restoring the original position of said pawl after each cycle, an indicator knob rotatably and slidably mounted on said spindle, said knob comprising a ratchet surface formed substantially around its periphery which can be engaged by said pawl to rotate said knob about said spindle, an axially facing side with a graspable protrusion disposed so as to allow said knob to be manually rotated about said spindle, and limiting means interacting with said frame for limiting the rotational movement of said knob about said spindle, biasing means disposed between said frame and said knob for urging said knob to its most distal position from said frame, releasable latch means disposed for holding said knob in a position proximate to said frame and for releasing said knob upon said pawl rotating said knob to a predetermined position, and switch means mounted on said frame to be engaged by said knob in said proximate position and actuated by said knob for energizing said circuit during the cycle of operation and de-energizing said circuit upon said completion of said cycle.

2. A device as claimed in claim 1 wherein said latch means comprises a tapered flange protruding from the periphery of said knob and a resilient catch mounted on said frame and disposed so as to interact with said flange.

3. A device as claimed in claim 2 wherein said catch comprises a leaf spring having one end adapted so as to engage said tapered flange.

4. A device as claimed in claim 3 wherein said leaf spring is adjustably mounted on said frame to provide variable tension on said periphery of said knob thereby varying the force required to lift or depress said knob.

5. A device as claimed in claim 1 wherein said knob has indicia printed on said flat side as said graspable protrusion for indicating the number of cycles to be processed.

6. A device as claimed in claim 1 wherein said limiting means comprises a recessed annular groove on the opposing side of said knob as said graspable protrusion, said groove partially encircling said spindle and interacting with said frame so as to limit the rotation of said knob about said spindle.

7. A device as claimed in claim 1 which further comprises a second leaf spring adapted to engage said ratchet surface on said periphery of said knob so as to limit the rotation of said knob to discrete intervals as determined by the spacings of said ratchet surface.

8. A device as claimed in claim 7 wherein the ratchet surface is modified to afford rotation of the knob in either direction against the engagement of the second leaf spring.

9. A device as claimed in claim 1 including means to restore said knob to its original position.

10. A device as claimed in claim 1 wherein said ratchet surface is interrupted by an area having no teeth so as to provide a position on said knob at which said ratchet pawl will not rotate said knob.

* * * * *

UNITED STATES PATENT AND TRADEMARK OFFICE

CERTIFICATE OF CORRECTION

PATENT NO. : 4,255,650

DATED : March 10, 1981

INVENTOR(S) : Norman L. Giorgini and John W. Ulseth

It is certified that error appears in the above—identified patent and that said Letters Patent is hereby corrected as shown below:

Column 2, line 12, change "29" to --24--;

line 34, delete "when" and insert therefor --which--.

Signed and Sealed this

Eleventh Day of August 1981

[SEAL]

*Attest:*

GERALD J. MOSSINGHOFF

*Attesting Officer*

*Commissioner of Patents and Trademarks*